US007984628B2

(12) United States Patent
Nishio et al.

(10) Patent No.: US 7,984,628 B2
(45) Date of Patent: Jul. 26, 2011

(54) WASHING MACHINE CAPABLE OF DETECTING LEAKAGE AT WATER FEED UNIT

(75) Inventors: Masahiro Nishio, Nara (JP); Kazuhiko Taniguchi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1708 days.

(21) Appl. No.: 10/824,023

(22) Filed: Apr. 14, 2004

(65) Prior Publication Data

US 2004/0211228 A1 Oct. 28, 2004

(30) Foreign Application Priority Data

Apr. 22, 2003 (JP) ..... 2003-116436

(51) Int. Cl.
*D06F 33/00* (2006.01)

(52) U.S. Cl. ..... 68/12.01; 68/12.07; 68/12.02; 68/12.05

(58) Field of Classification Search ..... 68/12.01, 68/12.07, 12.05, 12.02
See application file for complete search history.

(56) References Cited

U.S. PATENT DOCUMENTS

| | | | | |
|---|---|---|---|---|
| 4,696,171 | A * | 9/1987 | Babuin | 68/207 |
| 4,955,213 | A * | 9/1990 | Ohsugi et al. | 68/12.12 |
| 5,000,015 | A * | 3/1991 | Nakamura et al. | 68/23.3 |
| 6,840,553 | B2 * | 1/2005 | Dirnberger et al. | 292/341.16 |

FOREIGN PATENT DOCUMENTS

| | | | |
|---|---|---|---|
| DE | 1 860 129 | | 10/1962 |
| DE | 40 38 802 | A1 | 6/1992 |
| DE | 694 19 446 | T2 | 10/1994 |
| DE | 195 05 414 | C2 | 8/1996 |
| DE | 195 28 322 | C2 | 2/1997 |
| DE | 196 08 866 | A1 | 9/1997 |
| GB | EP0028067 | A1 * | 5/1981 |
| JP | 63-107456 | | 5/1988 |
| JP | 2001-259289 | | 9/2001 |
| JP | 2001-347093 | | 12/2001 |

OTHER PUBLICATIONS

German Office Action for corresponding Application No. 10 2004 018 825.4-26 dated Feb. 10, 2005.

* cited by examiner

*Primary Examiner* — Michael Cleveland
*Assistant Examiner* — Samuel A Waldbaum
(74) *Attorney, Agent, or Firm* — Renner, Otto, Boisselle & Sklar, LLP

(57) ABSTRACT

When an operation for washing is completed and door is unlocked, water level in a water tank is monitored only for a prescribed time period. When there is no water leakage, monitoring is stopped after the prescribed time period and the power is turned off. When there is a water leakage, water level in the water tank increases. When it is detected that a first water level is reached, the door is locked to prevent opening. After a prescribed time period, the power is turned off while the door is kept locked. If the door cannot be locked, the door lock error is notified and the water collected in the water tank is drained.

11 Claims, 10 Drawing Sheets

WASHING MACHINE CAPABLE OF DETECTING LEAKAGE AT WATER FEED UNIT

This nonprovisional application is based on Japanese Patent Application No. 2003-116436 filed with the Japan Patent Office on Apr. 22, 2003, the entire contents of which are hereby incorporated by reference.

BACKGROUND OF THE INVENTION

1. Field of the Invention

The present invention relates to a washing machine automatically executing an operation including the steps of washing, rinsing and dehydration in order, optionally followed by the step of drying, and turning power off at the end of the automatic operation.

2. Description of the Background Art

A drum-type washing machine executes an automatic operation including the steps of washing, rinsing, dehydration and drying in this order. The operation will be described with reference to FIG. 11. First, a user turns on a power key, the power is fed to a control circuit (step SA1, hereinafter, "step" will be omitted), and input course and settings of operation, for example, are displayed. At this time, water level in a water tank is detected (SA2). When water level higher than an arbitrarily set level (which will be referred to as door-open prohibiting level) is detected, the door is locked (SA3). When the water level in the water tank is higher than the door-open prohibiting level and the user opens the door carelessly, water leaks out from the water tank to the outside of the washing machine. Therefore, the door is kept closed to prevent water leakage. Then, a drainage pump is activated (SA4) to drain off the water left in the water tank to a reset water level (SA5). After the end of drainage, operation of the drainage pump is stopped (SA6) and the door lock is released (unlocked) (SA7).

After the door lock is released, or when water level higher than the door-open prohibiting level is not detected, the door may be opened, and therefore, the user opens the door, put in the laundry and closes the door. When the user inputs a change in the course or settings of operation at this stage, setting of operation conditions is changed (SA9). When, the start key is operated (SA10), the door is again locked (SA11), water feed starts, and the operation proceeds from the step of washing through rinsing, dehydration to drying.

When the operation ends (SA13), function of all loads including a motor, a pump, a fan, and a water feed valve are turned off (SA14), door lock is released (SA15), power supply to the control circuit is stopped (SA16) and the power is turned off (SA17).

When the water feed valve is out of order or blocked up by foreign matters such as dust or sand, the function of shutting-off water cannot properly be attained even when the power is turned off to close the water valve at the end of operation. Consequently, water leaks from the water feed valve and the water builds up in the water tank. This leads to a trouble that the water overflows from the water tank and flows to the outside of the washing machine, or water flows down when the door is opened while the power of the washing machine is off.

As a solution, Japanese Patent Laying-Open No. 2001-347093 discloses, in paragraphs [0024] and [0025], a technique in which after the end of a series of operations in a washing machine, when it is detected that a prescribed water level is reached in the water tank, the power is turned on, the door is locked and the water is drained off.

As described above, in the conventional washing machine, water level of the water tank is detected, and various measures are taken to prevent water leakage from the water tank. In view of the foregoing, some conventional washing machines have a function of continuously monitoring leakage at a water feed valve in a standby state (while not in operation).

In order to continuously monitor water leakage in the standby state of the washing machine, it is necessary to feed power to a water level sensor continuously, in the standby state of the washing machine.

Though the user wishes to know any water leakage, he/she also wishes to save power consumption of the washing machine as much as possible.

SUMMARY OF THE INVENTION

The present invention was made in view of the foregoing and its object is to provide a washing machine and a method of controlling a washing machine that can detect leakage at a water feed unit and save power consumption.

According to an aspect, the present invention provides a washing machine including a drum having an axis of rotation in a direction crossing a vertical direction and a water tank surrounding the drum, further including: a water level detecting unit detecting level of water in the water tank; and a control portion operating the washing machine for washing; and when the operation for washing is completed, the control portion causes the water level detecting unit to detect water level in the water tank only for a prescribed time period and thereafter power supply to the control portion is turned off.

According to another aspect, the present invention provides a washing machine, including a drum having an axis of rotation in a direction crossing a vertical direction and a water tank surrounding the drum; wherein the water tank has an opening in a plane crossing the axis of rotation; the washing machine including: a door opening and closing the opening of the water tank; a water feed unit for feeding water to the water tank; a water leakage detecting unit monitoring water leakage at the water feed unit; and a control portion operating the washing machine for washing; and when the operation for washing is completed, the control portion causes the leakage detecting unit to monitor water leakage at the water feed unit only for a prescribed time period and thereafter power supply to the control portion is turned off.

Further, preferably, the washing machine in accordance with the present invention further includes a lock unit for preventing opening of the door, and the control portion causes the lock unit to lock the door when the leakage detecting unit detects water leakage at the water feed unit.

Preferably, the washing machine in accordance with the present invention further includes a drainage unit draining water in the water tank; and a lock detecting unit detecting whether the door is locked by the lock unit or not; and when the water leakage detecting unit detects a water leakage at the water feed unit, the lock unit is activated not to open the door and the lock detecting unit detects that the door is not locked, the control portion causes the drainage unit to drain off the water in the water tank.

According to a still further aspect, the present invention provides a washing machine including a drum having an axis of rotation in a direction crossing a vertical direction and a water tank surrounding the drum; wherein the water tank has an opening in a plane crossing the axis of rotation; the washing machine including: a water level detecting unit detecting water level in the water tank; a door opening and closing the opening of the water tank; a lock unit for locking the door; and a control portion operating the washing machine for washing;

and when the operation for washing is completed, the control portion causes the water level detecting unit to detect water level in the water tank only for a prescribed time period, and when the water level detecting unit detects a water level not lower than a first water level as the lowest water level detectable by the water level detecting unit, causes the lock unit to lock the door, and when the water level detecting unit does not detect a water level not lower than the first water level, power supply to the control portion is turned off.

Preferably, in the washing machine in accordance with the present invention, when the operation for washing is completed, the control portion causes the lock unit to unlock the door.

Preferably, the washing machine in accordance with the present invention further includes a drainage unit draining water in the water tank; and a lock detecting unit detecting whether the door is locked by the lock unit or not; and when the water level detecting unit detects a water level not lower than the first water level after the completion of the operation for washing and the lock detecting unit detects that the door is not locked by the lock unit, the control portion causes the drainage unit to drain off the water in the water tank.

Preferably, the washing machine in accordance with the present invention further includes a drainage unit for draining off the water in the water tank; and after completion of the operation for washing, when the water level detecting unit detects a water level not lower than a second water level higher than the first water level, the control portion causes the drainage unit to drain off the water in the water tank.

Preferably, in the washing machine in accordance with the present invention, the second water level is positioned lower than a lowermost plane of the opening of the water tank.

Preferably, the washing machine in accordance with the present invention further includes a water feed unit for feeding water to the water tank; and the prescribed time period is set in accordance with a time period calculated from a minimum flow rate of water fed from the water feed unit and a smallest amount of water detectable by the water level detecting unit.

Further, in the washing machine in accordance with the present invention, preferably, when the lock unit is caused to lock the door and the lock detecting unit detects that the door is not locked, the control portion notifies that the door is not locked.

According to the present invention, in a washing machine, change in water level of the water tank at the end of operation is detected by the water level detecting unit to find any water leakage, or water leakage is directly detected by a water leakage detecting unit monitoring leakage at the water feed unit. The water leakage detecting unit directly detects water flowing out from the water feed unit, by utilizing a water flow sensor detecting any water flow, a flow rate sensor or the like. The water level sensor detecting the water level of the water tank is also considered to be one type of the water leakage detecting unit.

Specifically, a control portion executes water level detection only for a prescribed time period at the end of operation to find any water leakage at the water feed unit, and when it is detected that the water has reached a first water level higher than a detectable reference level, it determines that there is a water leakage, and locks the door. When it is not detected in the prescribed time period that the water has reached the first water level, it is determined that there is no water leakage, and the power is turned off. Alternatively, water leakage may be directly detected, and when any water leakage is found, the door is locked. When any water leakage is not detected in the prescribed time period, the power is turned off.

When it is confirmed that there is not water leakage after monitoring the water leakage for a prescribed time period, it is not likely that water leakage occurs thereafter. Thus, it becomes unnecessary to further monitor the water leakage and, therefore, power is immediately turned off. Unnecessary monitoring is stopped and unnecessary power consumption can be prevented.

Further, a lock detecting unit for detecting the door-locked state is provided. When it is detected that the door is not locked, the control portion causes a drainage unit to drain off the water in the water tank. Further, when it is detected that the door is not locked, the control portion makes a notification of the state.

The user cannot open the door when it is locked, and therefore, there is no possibility of overflow even when water builds up in the water tank. If the door is not locked, however, the door may be opened inadvertently and the water flows out. Thus, water is drained off to prevent any accidental water leakage.

Further, when it is detected that the water has reached a second water level higher than the first water level, the control portion causes the drainage unit to drain the water off. The second water level is set to be lower than the lowermost plane of the opening of the water tank. By setting such a second water level, water built up in the water tank can be drained before it overflows, no matter whether the door is locked or not. Further, it is possible to identify and appropriately fix the cause of leakage in the meantime.

The aforementioned prescribed time period is set in consideration of the time period calculated from the minimum flow rate of water fed from the water feed unit and the amount of water reaching the detectable reference level. Accordingly, the monitoring time will not be excessively long, and unnecessary monitoring can be avoided. As a result, efficient monitoring of water leakage becomes possible, enabling leakage prevention with minimum electric power.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
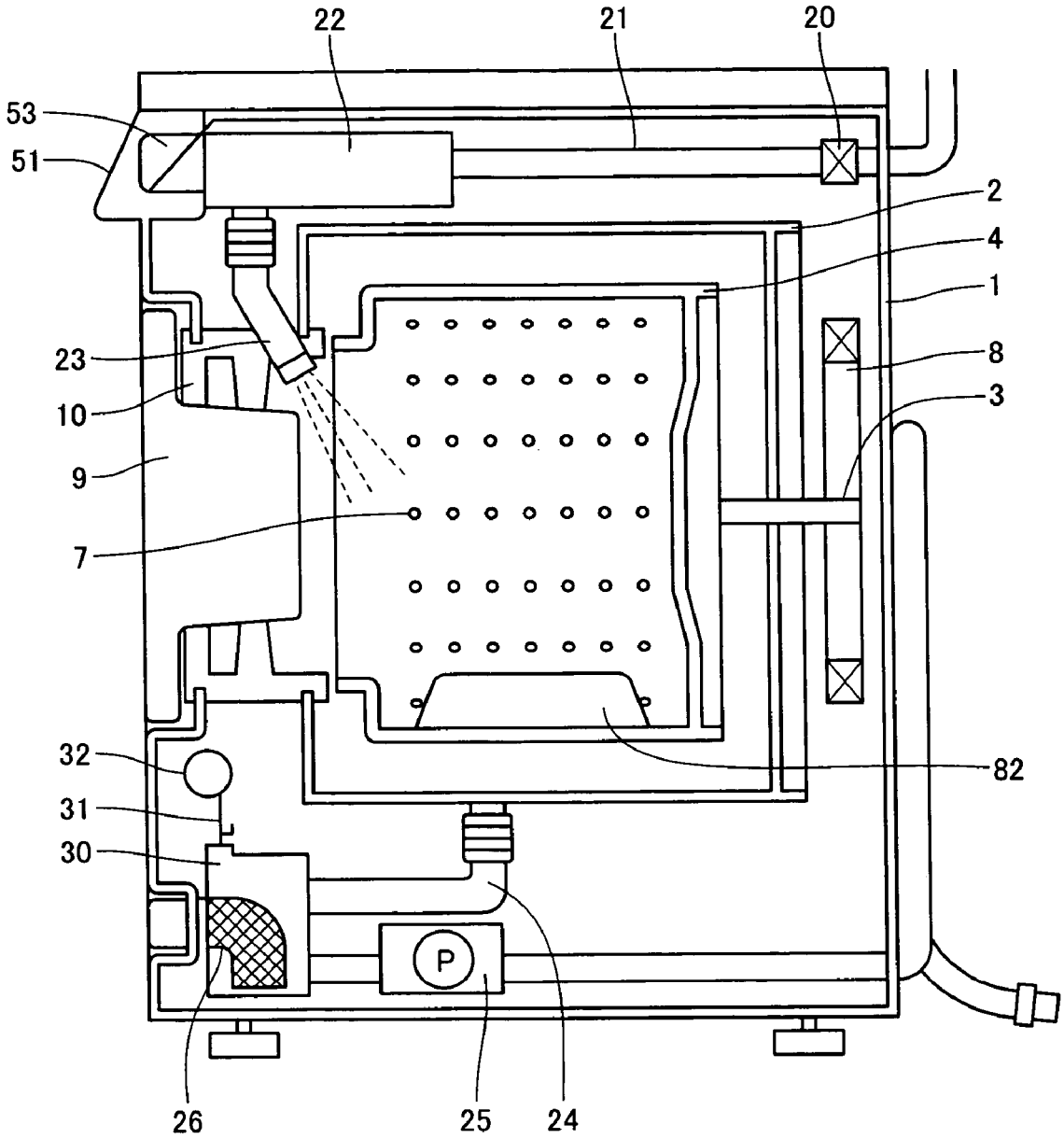
FIG. 1 is a cross sectional side view of a washing machine in accordance with one embodiment of the present invention.
Figure 2:
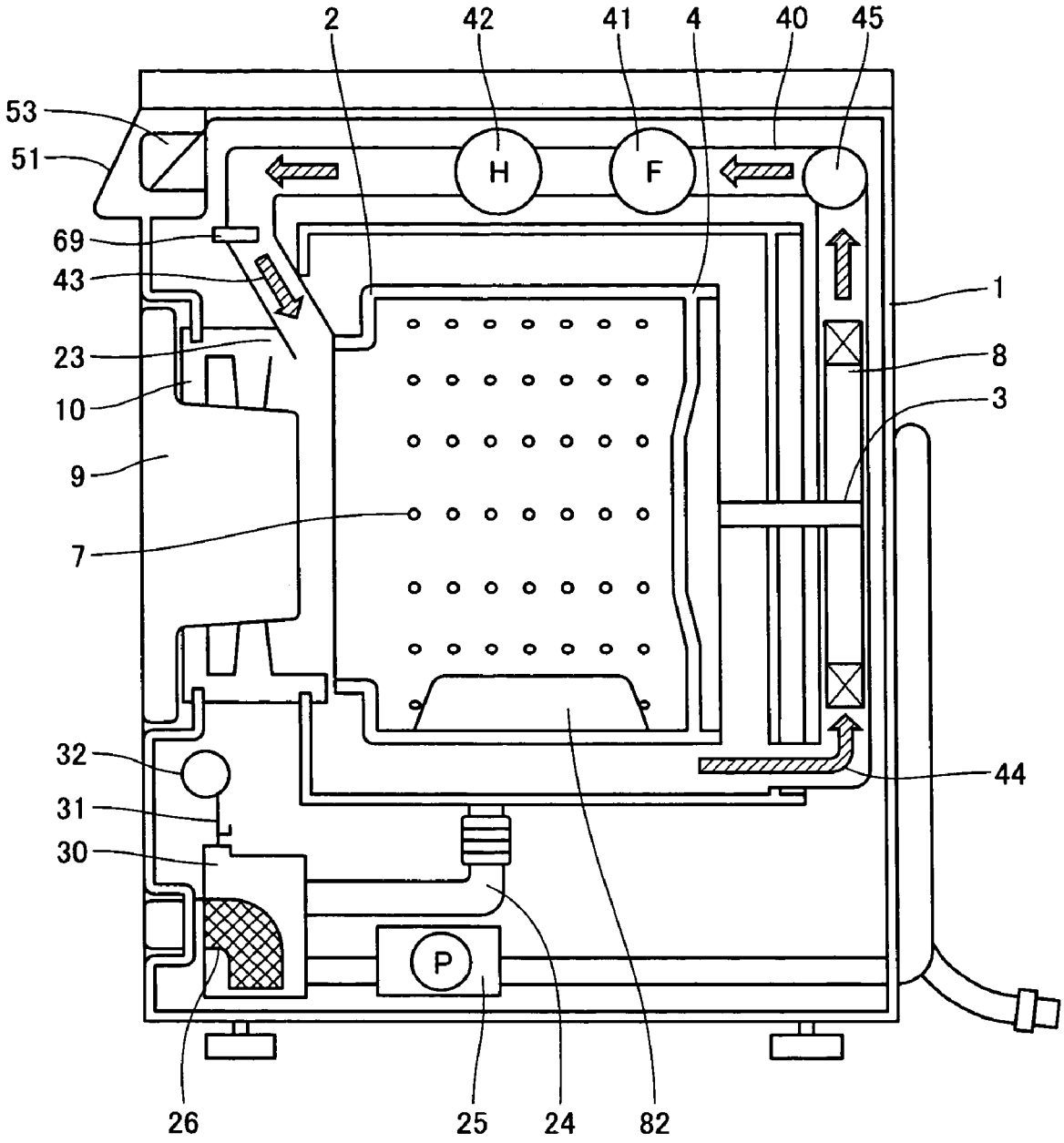
FIG. 2 is a cross sectional side view of the washing machine of FIG. 1, taken from a different portion.
Figure 3:
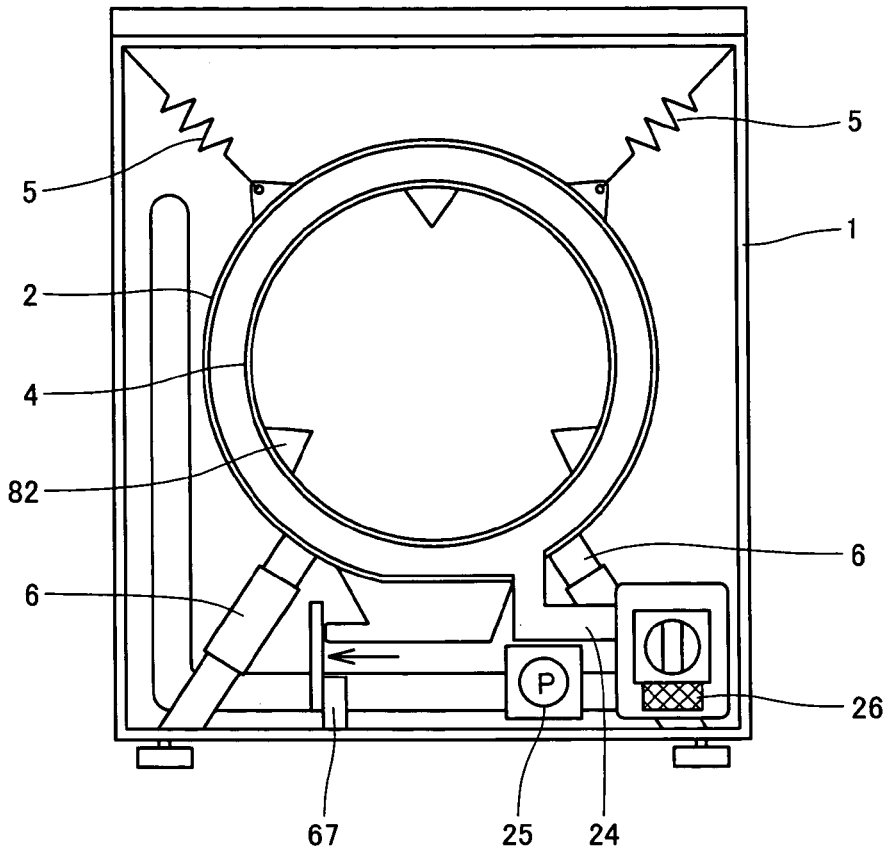
FIG. 3 is a frontal cross section of the washing machine of FIG. 1.
Figure 4:
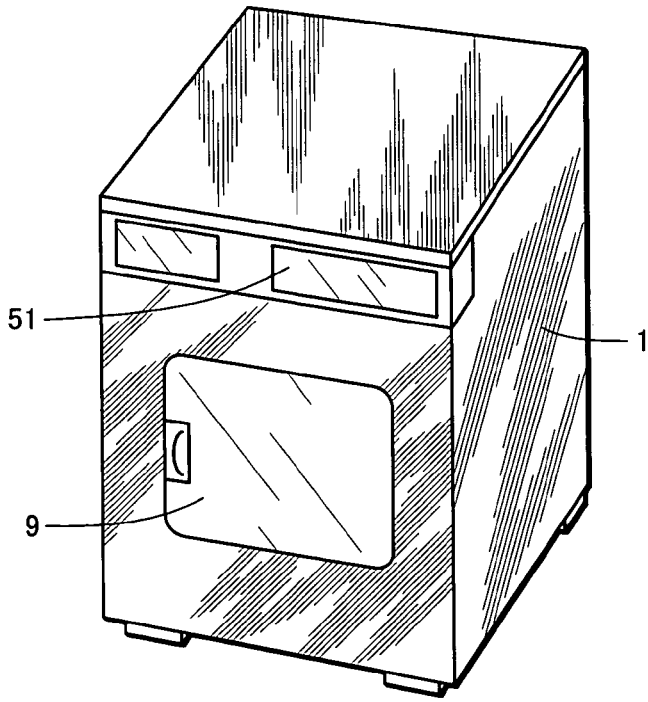
FIG. 4 is a perspective view showing the appearance of the washing machine of FIG. 1.

FIGS. 1 to 4 represent a drum-type washing machine having a drying function, in accordance with an embodiment of the present invention. The washing machine has a double structure of a water tank 2 resiliently supported inside an outer housing 1 and a drum 4 arranged rotatable about a transverse shaft 3 in water tank 2.

In order to absorb vibration during an operation, water tank 2 is suspended by means of a spring 5 from above, and supported by means of an anti-vibration dumper 6 from below, and has a function of pooling and draining water for washing and dehydration. Entirely over the circumferential wall of drum 4, a large number of small holes are perforated to pass water fed at the time of washing and to pass drainage water at the time of dehydration. On a back surface of drum 4, a transverse shaft 3 that is horizontal or slightly inclined upward is fixed, and transverse shaft 3 is rotatably supported by water tank 2. Behind the back surface of water tank 2, a driving motor 8 is provided for rotating drum 4. Driving motor 8 includes a rotor (not shown) fixed on one end of transverse shaft 3 and a stator (not shown) provided to surround the rotor, provided on the back surface of water tank 2.

On the front surface of outer housing 1, a door 9 is provided for taking laundry in and out. The door 9 is structured to open/close the opening at the front surface of drum 4 and the opening at the front surface of water tank 2 and to tight-seal water tank 2 by means of a packing 10 provided between door 9 and water tank 2. The openings are formed at approximately the same horizontal level. A lock mechanism 11 is provided as a locking unit for preventing door 9 from opening. Lock mechanism 11 is a latch type mechanism that is activated when power is turned on for locking or unlocking the door 9. It is controlled to lock during an operation or in an abnormal state of the washing machine to prevent opening of door 9. Once activated, lock mechanism maintains its state regardless of power on/off.

Above water tank 2, a main water feed valve 20 is provided as a water feed unit. When main water feed valve 20 is opened, tap water flows through a water feed pipe 21 and dissolves detergent in a detergent case 22, and thus washing water is supplied through a water inlet 23 to water tank 2 and drum 4. A drainage duct 24 is connected to a lower portion of water tank 2, and a drainage pump 25 for draining washing water in water tank 2 to the outside of the machine is inserted. These components form a drainage unit. A lint trap 26 is provided in the middle of drainage duct 24, which is removable through a lower portion at the front side of outer housing 1.

Water level in water tank 2 is detected utilizing a change in pressure in an air trap 30 provided above lint filter 26. The change in pressure is transmitted through a pressure conducting pipe 31 connected to air trap 30 to a water level sensor 32. In water level sensor 32, a magnetic body moves in a coil in accordance with the pressure, and a resulting change in coil inductance is detected as a change in oscillation frequency, whereby the water level is detected. Air trap 30, pressure conducting pipe 31 and water level sensor 32 constitute a water level detecting unit. Water level sensor 32 is not limited to a hydraulic type, and a floating type sensor or an optical sensor may be used.

The washing machine of the present embodiment further includes a mechanism for feeding hot air in drum 4, for drying the laundry. A cooling duct 40 communicated with drum 4 through the circumference of water tank 2 from the lower portion of water tank 2, and in cooling duct 40, a blower fan 41 and a drying heater 42 are inserted. The air heated by drying heater 42 is introduced trough air outlet 43 to water tank 2. The hot air passes through small holes 7 of drum 4, goes through the inside of drum 4 and circulates through cooling duct 40 as represented by arrows in FIG. 2 from a circulation inlet 44 at a lower portion of water tank 2. On an upstream side than blower fan 41 above cooling duct 40, a water feed valve 45 for drying is provided as a cooling unit. Cooling water is sprayed from water feed valve 45 for drying to cooling duct 40, which water contacts air with high humidity coming out from water tank 2, and the moisture in the air is condensed. Thus, moisture in the air is removed. The air with the humidity thus lowered is again heated by drying heater 42, to be hot air. This cooling water can also be collected in water tank 2, and therefore, water feed valve 45 for drying also functions as a water feed unit.

Figure 5:
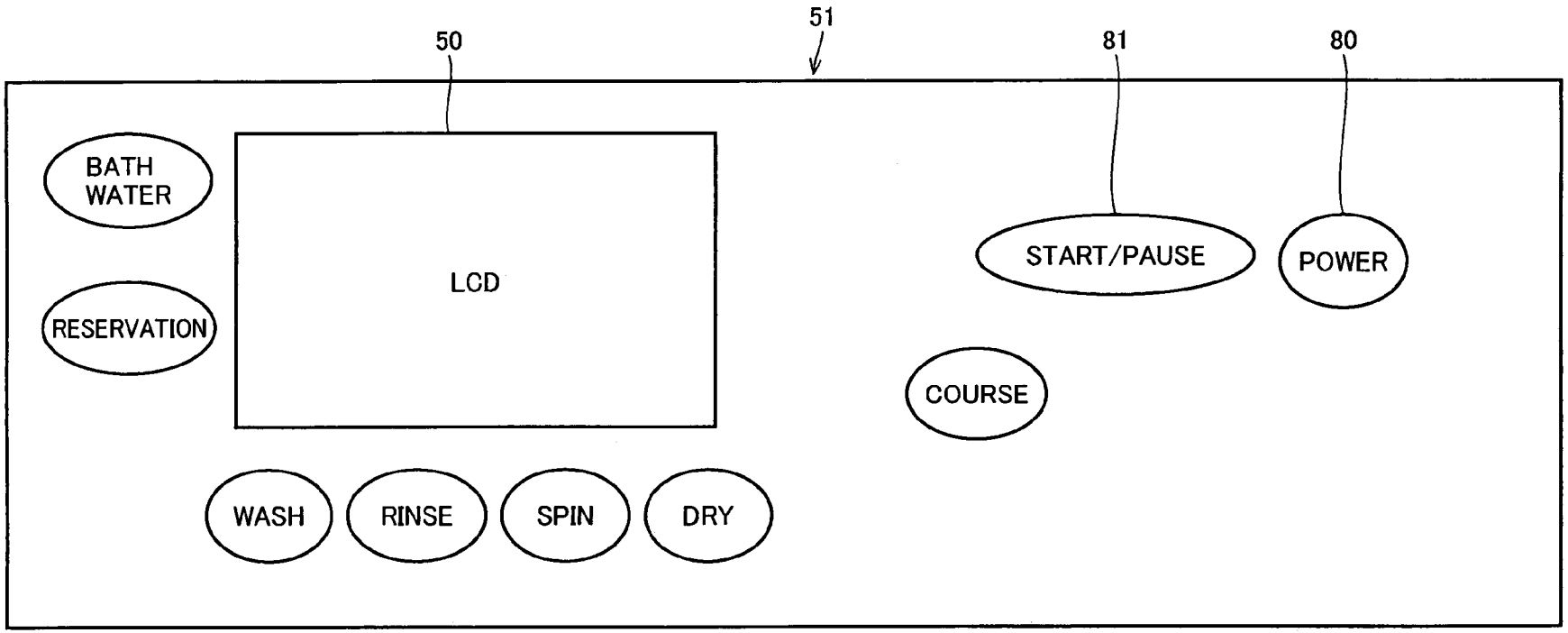
FIG. 5 represents a display and operation panel of the washing machine of FIG. 1.
Figure 6:
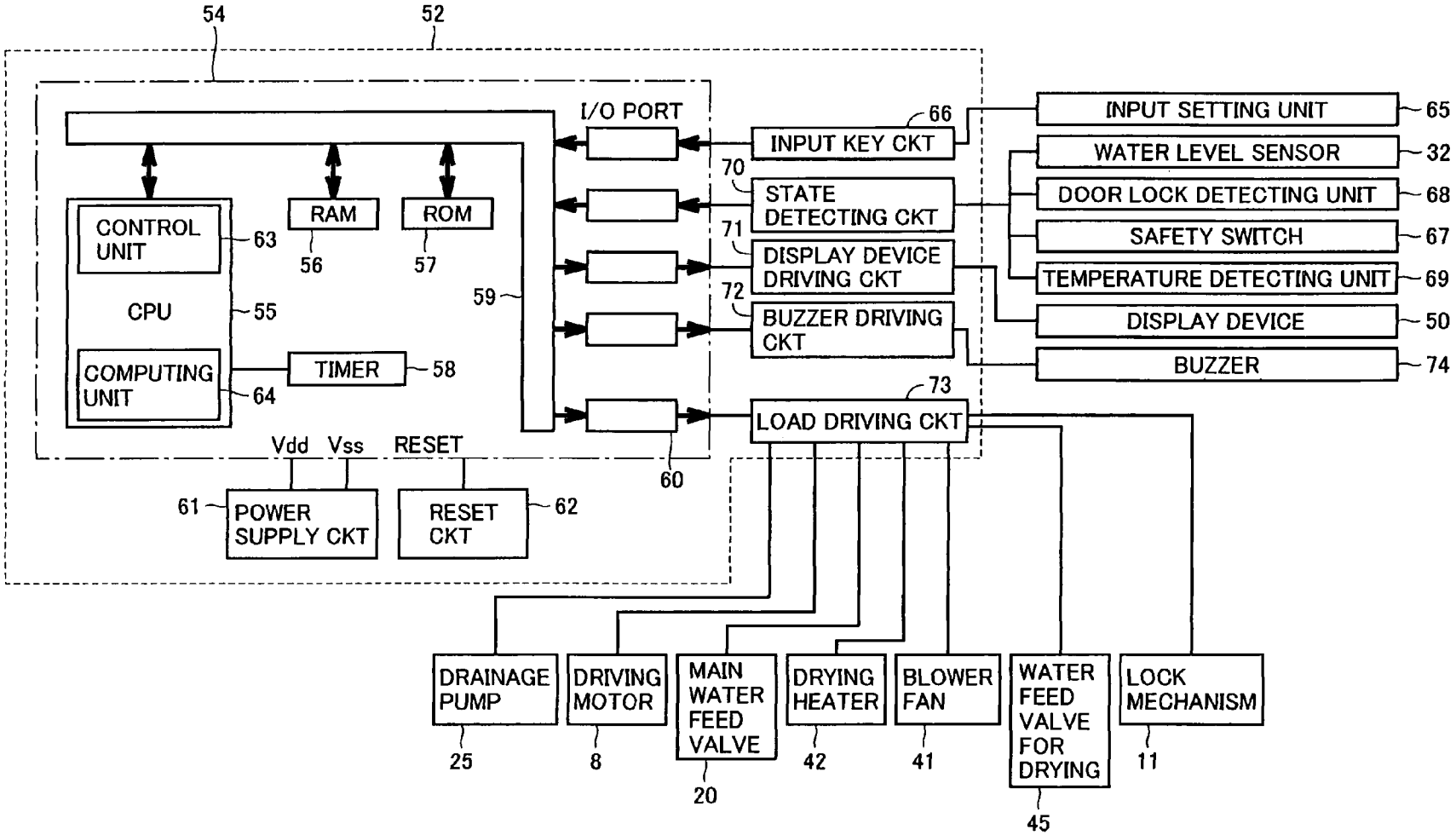
FIG. 6 is a block diagram of a control circuit of the washing machine shown in FIG. 1.

On an upper portion at the front of outer housing 1, an operation and display panel 51 having various keys and a display device 50 such as a liquid crystal display as shown in FIG. 5 is provided, and a circuit board 53 having control circuit 52 mounted thereon is attached to the backside of the panel. As shown in FIG. 6, control circuit (control portion) 52 has a microcomputer 54 that includes a CPU (Central Processing Unit) 55, an RAM 56 (Random Access Memory) 56, an ROM (Read Only Memory) 57, a timer 58, a system bus 59 and a plurality of I/O (Input/Output) ports 60. Microcomputer 54 operates as it receives a constant voltage at power supply terminals Vdd and Vss from a power supply circuit 61, and is reset when a reset signal is input from a reset circuit 62 to a RESET terminal 62.

CPU 55 of microcomputer 54 has a control unit 63 and a computing unit 64. Control unit 63 takes out a program stored in ROM 57 and executes the same. Computing unit 64 performs operations including binary addition, logic operation, addition/subtraction and comparison, on data input from various input devices such as switches and sensors and from RAM 56, in accordance with a control signal applied from control unit 63. Therefore, in ROM 57, data and software for operating various output devices such as motor and valves, conditions set for making various decisions, rules for processing various pieces of information and so on are stored in advance.

Microcomputer 54 is connected, through I/O port 60, to an input key circuit 66, which is connected to an input setting unit 65 (operation keys) for starting operation, pausing operation, selecting a course of operation and so on, as well as to a state detecting circuit 70, to which water level sensor 32, a safety switch 67, door lock detecting unit 68 and a temperature detecting unit 69 for detecting temperature in outer housing 1 are connected. When a signal is input from state detecting unit 70 to microcomputer 54, microcomputer 54 performs computing operation in accordance with the signal and controls a display device driving circuit 71, a buzzer driving circuit 72 and a load driving circuit 73. Further, based on an output from water level sensor 32, it monitors the water level, and controls driving of lock mechanism 11 and drainage pump 25.

Display device driving circuit 72 drives display device 50 provided on operation display panel 51. Buzzer driving circuit 72 sounds a buzzer at the end of key input, at the end of operation and when an unusual situation occurs, to inform the user. To load driving circuit 73, drainage pump 25, driving motor 8, main water feed valve 20, drying heater 42, blower fan 41, water feed valve 45 for drying and lock mechanism 11 are connected, which are activated by a driving signal from microcomputer 54.

Figure 7:
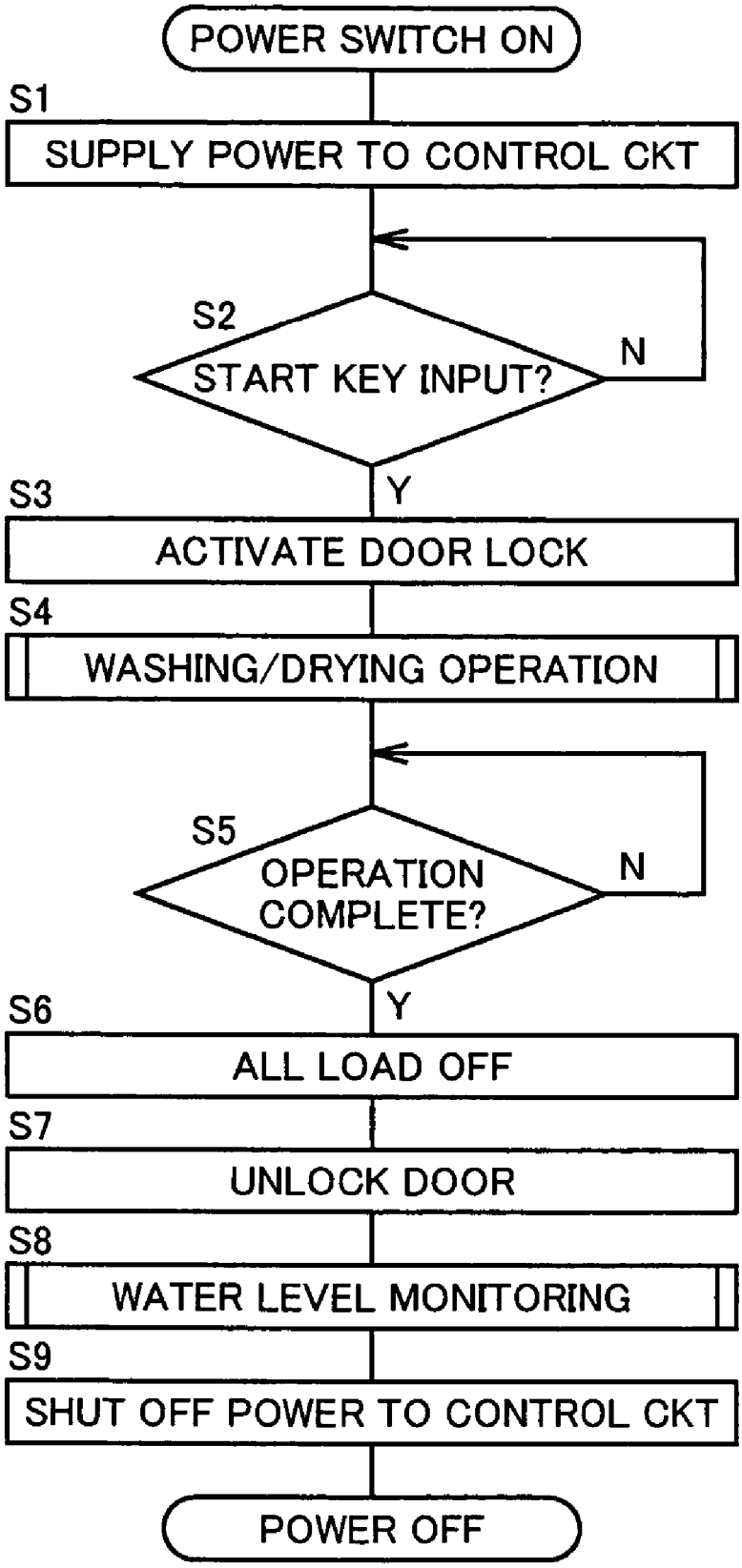
FIG. 7 is a flowchart of control during an operation of the washing machine of FIG. 1.

Operation of control circuit 52 for operating the washing machine will be described with reference to FIG. 7. Basic operation of the washing machine in accordance with the present embodiment is the same as the conventional one. When a power key 80 is turned on, power is fed to control circuit 52, and course of operation and the like are displayed on display device 50 (S1). At this time, water level of water tank 2 is detected in the conventional manner.

When the user opens the door 9, puts in the laundry, closes the door 9 and turns the start key 81 on (S2), the door of the washing machine is locked (S3), and the washing operation (washing and drying) starts from the step of washing. In the washing step, main water feed valve 20 is opened. The fed water passes through detergent case 22, and water with detergent dissolved therein flows through water inlet 23 to water tank 2 and drum 4. After the laundry is soaked into the washing water, drum 4 is rotated at a low speed. The laundry is lifted up approximately to the top of the drum 4 by a baffle 82 and by centrifugal force caused by the rotation of drum 4, and falls down because of the weight of itself This is called "tumbling." By repetitive tumbling, the laundry is cleaned by the force it receives when it dashes down. Then, the washing water in water tank 2 is drained.

Following the washing step, rinsing starts. After drainage of washing water from water tank 2, a cycle of intermediate spin-dehydration and rinsing in pooled water is repeated for a number of times. In the intermediate spin-dehydration step, drum 4 is rotated at a low speed such that the laundry moves to and stay on the inner circumferential wall, while imbalance detection takes place, in which amount of eccentricity, that is, magnitude of eccentric load of drum 4, is detected. When the imbalance is smaller than a determination value, rotation speed of drum 4 is increased. When it is determined that the imbalance is excessive (higher than a determination value), drum 4 is rotated while feeding water to untangle the laundry and to correct the imbalance. In the intermediate spin-dehydration step, the laundry is forced against the inner circumferential wall of drum 4 by centrifugal force caused by high-speed rotation, and the washing water is removed from the laundry to the outside of drum 4. Here, the wastewater is spin-out through small holes 7 of drum 4, flows down on an inner surface of water tank 2, enters drainage duct 24, and discharged to the outside of the washing machine by means of drainage pump 25. In the step of rinsing, water is fed to water tank 2 and drum 4 to soak the laundry, and drum 4 is rotated at a low speed. The laundry is rinsed by the force caused by tumbling. Then, the water is drained off. The water level of water tank 2 when water is fed for washing or rinsing is detected by water level sensor 32, and when a set water level is reached, feeding of water stops.

Following the rinsing step, the step of spin-dehydration starts. The step of spin-dehydration is similar to the intermediate spin-dehydration step. When water tank 2 vibrates too much during this step, safety switch 67 is activated to stop the spin-dehydration step. Then, the same operation as performed when excessive imbalance is detected is started.

Following the spin-dehydration step, drying step starts. In the drying step, drum 4 is rotated at a low speed to cause tumbling operation while blower fan 41 and drying heater 42 are driven. By the action of blower fan 41, the air in drum 4 is passed through small holes 7 of drum 4, circulation inlet 44 of water tank 2, cooling duct 40 to drying heater 42, heated and as hot water, blown out from air outlet 43 to drum 4 and is circulated. The air absorbs moisture of the laundry in drum 4, and is sucked by blower fan 41 into cooling duct 42. The air with high humidity passes through cooling duct 42 while it is cooled by the cooling water supplied from water feed valve 45 for drying, and the temperature decreases. The supplied cooling water is very small in amount, generally at the flow rate of 0.3 L/min. Consequently, the air in cooling duct 40 has its moisture removed as water condenses, and the resulting air with low moisture reaches drying heater 42. The air heated by drying heater 42 is blown into water tank 2 through air outlet 43 as hot air, and again, the air contacts the laundry and absorbs water. The air is again sucked through circulation inlet 44 into cooling duct 40, and the humidity is removed therefrom in the similar manner. By the repetition of this operation, the laundry is dried. Humidity or temperature in drum 4 is detected by a humidity sensor or temperature sensor (not shown), and when a prescribed value is reached, the drying step is terminated. In the drying step, the water condensed from the removed humidity goes down through cooling duct 40, passes through circulation inlet 44 to drainage duct 24, and discharged to the outside of the washing machine. When the drying step ends, an air-cooling step starts, to cool the laundry. In the air-cooling step, blower fan 41 and water feed valve 45 for drying are operated for a prescribed time period, with the tumbling operation of drum 4. When the air-cooling step ends, the operation of the washing machine (washing and drying) is completed (S5), and therefore, all the loads including motor 8 and fan 41 are turned off (S6). Then, the door lock is released (unlocked) (S7).

If water feed valve 20 or 45 fails and kept open or when the valve 20 or 45 is clogged and cannot be fully closed, water leaks from the water feed valve 20 or 45 and water builds up in water tank 2 with time.

Therefore, control circuit 52 monitors water level (S8) for detecting any leakage from water feed valve 20 or 45, at the end of operation. When any water leakage is detected, the door is locked. If water leakage is not detected, power supply to control circuit 52 is stopped and the power is turned off.

Monitoring of water level is performed by detecting water level only for a prescribed time period without turning the power off, at the end of operation. The prescribed time period is set in accordance with the time calculated from the minimum flow rate of water flowing from water feed valve 20 or 45 and the amount of water when the first water level is reached. Specifically, the first water level is the lowest reference water level (reset water level) that is detectable. By way of example, it is the water level when the water is accumulated to a position between the lowermost portion of water tank 2 and the lowermost portion of drum 4. The minimum flow rate of water feed valve 20 and 45 is determined by the flow rate of that one of main water feed valve 20 and water feed valve 45 for drying which has the lower water feed capacity. For instance, when water feed valve 45 for drying has the flow rate of 0.3 L/min and main water flow valve 20 has the flow rate of 20 L/min, the minimum flow rate is 0.3 L/min. Assuming that the first water level is reached with 3 L of water and water leaks from water feed valve 45 for drying, it takes about 10 minutes to reach the first water level. Considering variation among components, the prescribed time period is set, for example, to 15 minutes. If the water leaks from main water feed valve, the first water level will be reached in about 18 seconds, and therefore, the leakage can be detected. The prescribed time period set in this manner is the shortest time period to allow determination as to whether all the water feed valves 20 and 45 operate properly. When there is no water leakage in this period, it becomes unnecessary to continue monitoring after the lapse of this period. In the washing machine in accordance with the present embodiment, unnecessary monitoring is not executed, and therefore, wasteful power consumption can be avoided.

Figure 8:
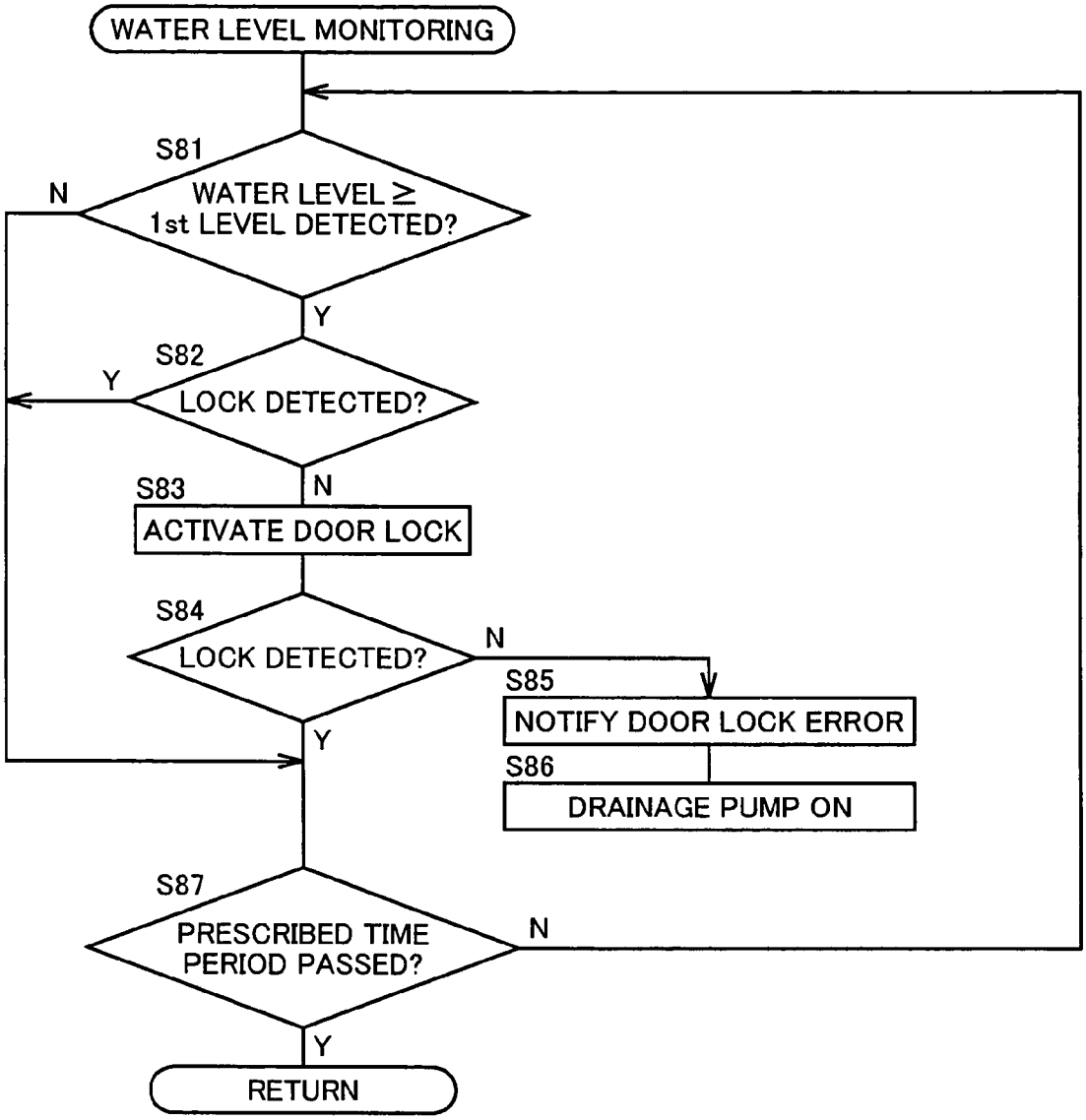
FIG. 8 is a flowchart of control during water level monitoring of the washing machine of FIG. 1.

The operation of control circuit 52 during water level monitoring of S8 will be described with reference to FIG. 8. When the operation of the washing machine is completed and the door lock is released (S7), water level monitoring starts (S8). In the water level monitoring, control circuit 52 detects an output signal from water level sensor 32, and saves the received data in RAM 56 in microcomputer 54 at every prescribed period. Control circuit 52 compares the data with a set data saved in ROM 57, for example the data of the first water level, and based on the result of comparison, determines whether the current water level is higher than the first water level or not (S81). When the water level is determined to be higher than the first level, it is the case that water leaks either from water feed valve 20 or 45. Therefore, power is fed to lock mechanism 11 to lock the door. After a prescribed time period (S87), by way of example, after 15 minutes, power supply to control circuit 52 is stopped, monitoring of water level is stopped, and the power is turned off with the door kept locked. Door lock is kept on even after the power is turned off, and therefore, overflow of water can be prevented by user's inadvertent opening of the door. At this time, water leakage may be informed by sounding buzzer 74 or by a display on display device 50.

Here, locking of the door is detected by door lock detecting unit 68. A known technique, such as detection of a latch activation by a micro-switch may be used for door lock detecting unit 68. Door lock detecting unit 68 outputs a Hi signal when the door is locked and Low signal when unlocked, to microcomputer 54. When the Low signal is input from door lock detecting unit 68 (S82), control circuit 52 energizes lock mechanism 11 (S83). After activation of lock mechanism 11, control circuit 52 determines that, as the LOW signal is input from door lock detecting unit 68 (S84), the door is not locked or the door 9 is open, and notifies a door lock error (S85). Control circuit 52 may notify the door lock error by sounding buzzer 74 or displaying a preset error code, for example "E02", on display device 50. In this manner, the user is immediately notified of the failure of the washing machine, and possible trouble caused by the water leakage can be avoided by appropriate repair or fixing.

After notification, control circuit 52 activates drainage pump 25 (S86). Water collected in water tank 2 is drained, and will not overflow from door 9. Even when the user is not around the washing machine when the notification is made, water can be drained off, and therefore, possible trouble caused by the water leakage can be avoided. In that case, the power may be kept on until a reset signal is input, and the operations of water level detection and drainage may be repeated.

Figure 9:
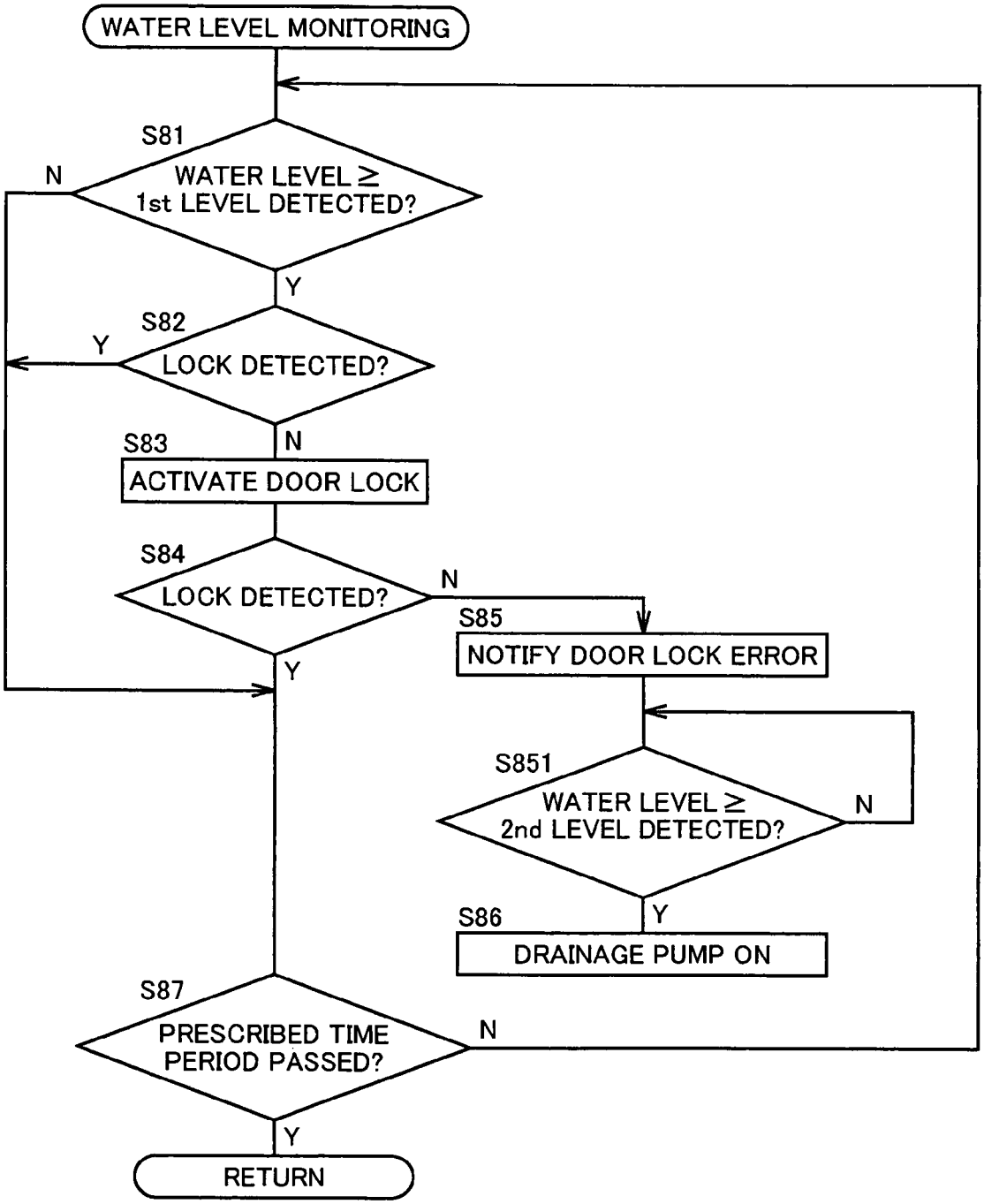
FIG. 9 is a flowchart of different control during water level monitoring of the washing machine of FIG. 1.

As an operation after notification of door lock error (S85), water level monitoring may be continued, rather than immediate drainage, as shown in FIG. 9. In that case, control circuit 52 continuously detects water level, and when it is detected that a second water level higher than the first level is reached (S851), activates drainage pump 25 (S86).

Figure 10:
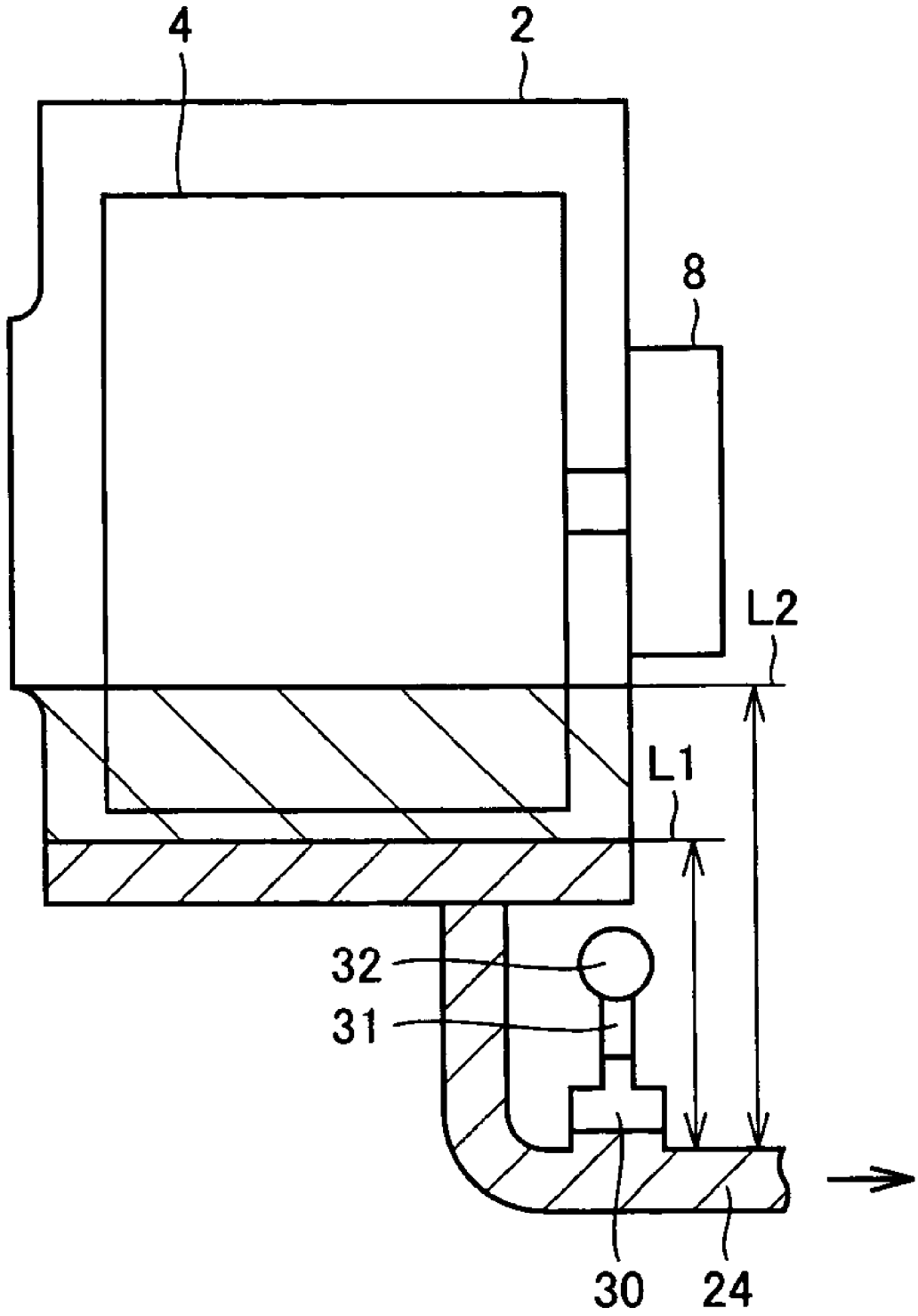
FIG. 10 indicates water levels set for monitoring water level in the washing machine of FIG. 1.
Figure 11:
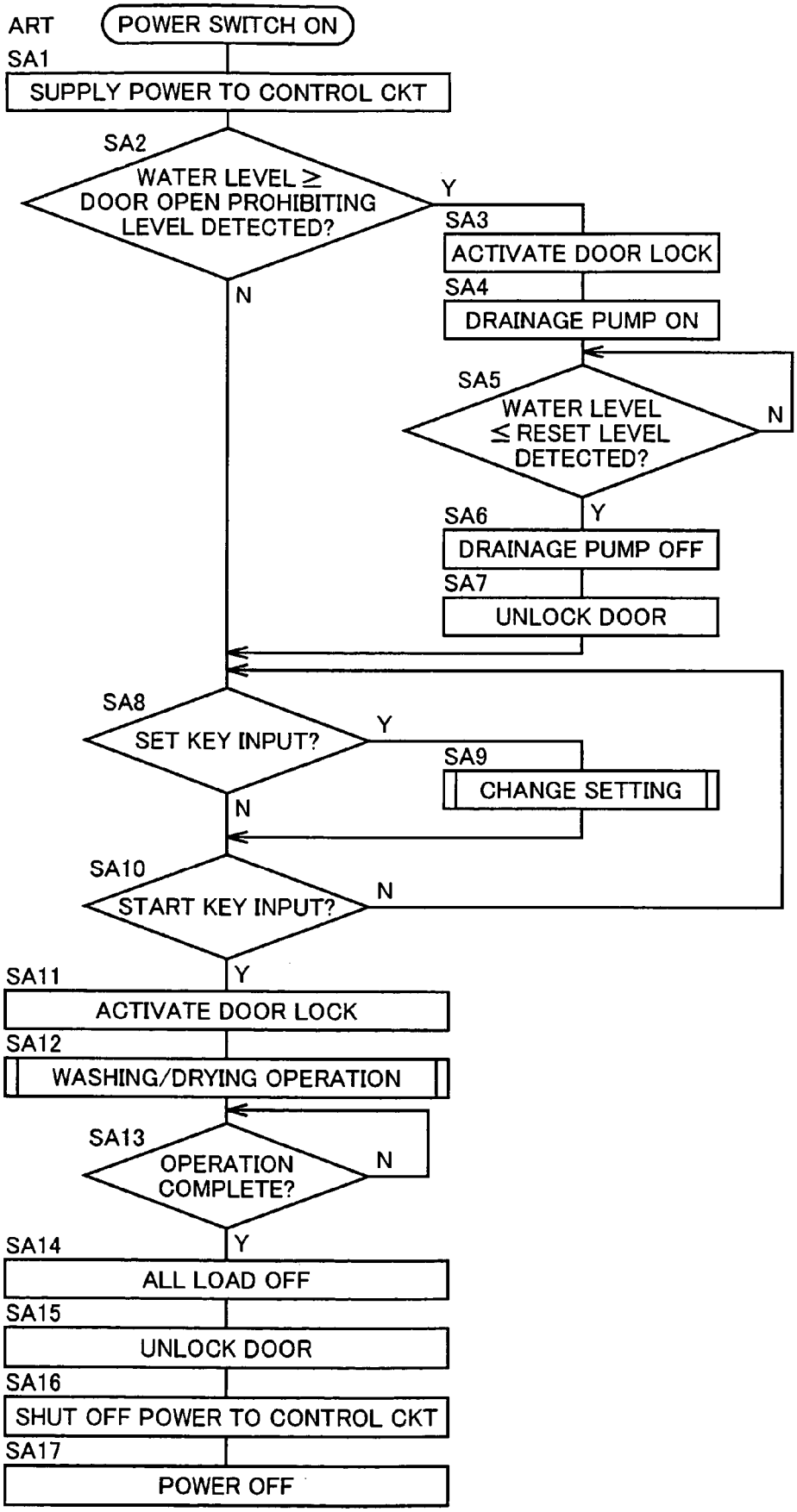
FIG.11 PRIOR ART
FIG. 11 is a flowchart of control during an operation of a conventional washing machine.

The second water level is set to a level L2 lower than the lowermost plane of the opening of water tank 2 as shown in FIG. 10, as door open prohibiting water level. Specifically, when the water builds up exceeding this level, the water flows out when the door 9 is opened, and therefore, at this water level, unlock of the door is prohibited. This is set to approximately the same horizontal level as the lowermost plane of the opening of drum 4 and water tank 2. In FIG. 10, the first water level is denoted by L1.

In the process shown in FIG. 9, after notification of door lock error (S85), when the second water level is detected (S851), drainage pump 25 is activated (S86) and water is drained off. Therefore, even when the door 9 is inadvertently opened upon notification of door lock error, overflow of water from the opened door 9 can be prevented, as the water is automatically drained when the water level increases and reaches the second water level.

As the water level for executing drainage in case of water leakage is set higher than the water level for notifying an error, it is possible for the user to know that water builds up in water tank 2 at the time the notification is given and to properly understand the situation. Accordingly, it would be possible for the user to correctly report the failure to a repair personnel, enabling appropriate repair or fixing of the failure.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A washing machine, including a drum having an axis of rotation in a direction crossing a vertical direction and a water tank surrounding said drum, comprising:

a water level detecting unit detecting level of water in said water tank;

a water feed unit for feeding water to said water tank; and a control portion operating said washing machine for performing a wash cycle including washing, rinsing, and draining;

said control portion being configured to recognize when said wash cycle is completed and upon such recognition, to cause said water level detecting unit to detect water level in said water tank only for a prescribed time period substantially equaling a smallest amount of water detectable by said water level detecting unit divided by a minimum flow rate of water fed from said water feed unit, and thereafter power supply to said control portion is turned off.

2. A washing machine, including a drum having an axis of rotation in a direction crossing a vertical direction and a water tank surrounding said drum; wherein said water tank has an opening in a plane crossing said axis of rotation;

said washing machine comprising:

a door opening and closing said opening of said water tank;

a water leakage detecting unit monitoring water leakage at said water feed unit and detecting the water level in said water tank; and a control portion operating said washing machine for performing a wash cycle including washing, rinsing, and draining;

said control portion being configured to recognize when said wash cycle is completed and upon such recognition to cause said leakage detecting unit to monitor water leakage at said water feed unit only for a prescribed time period substantially equaling a smallest amount of water detectable by said water level detecting unit divided by a minimum flow rate of water fed from said water feed unit, and thereafter power supply to said control portion is turned off.

3. The washing machine according to claim 2, further comprising a lock unit for preventing opening of said door;

said control portion being further configured to cause said lock unit to lock said door when said leakage detecting unit detects water leakage at said water feed unit.

4. The washing machine according to claim 3, further comprising:

a drainage unit draining water in said water tank; and a lock detecting unit detecting whether said door is locked by said lock unit or not; wherein when said water leakage detecting unit detects a water leakage at said water feed unit, said lock unit is activated not to open said door and said lock detecting unit detects that said door is not locked, said control portion being further configured to cause said drainage unit to drain off the water in said water tank.

5. The washing machine according to claim 4, said control portion being further configured, when said lock unit is caused to lock said door and said lock detecting unit detects that said door is not locked, to notify that said door is not locked.

6. A washing machine including a drum having an axis of rotation in a direction crossing a vertical direction and a water tank surrounding said drum; wherein said water tank has an opening in a plane crossing said axis of rotation;

said washing machine comprising:

a water level detecting unit detecting water level in said water tank;

a lock unit for locking said door;

a water feed unit for feeding water to said water tank; and a control portion operating said washing machine for performing a wash cycle including washing, rinsing, and draining;

said control portion being configured to recognize when said wash cycle is completed, and upon such recognition to cause said water level detecting unit to detect water level in said water tank only for a prescribed time period substantially equaling at least a smallest amount of water detectable by said water level detecting unit divided by a minimum flow rate of water fed from said water feed unit, and when said water level detecting unit detects a water level not lower than a first water level as said lowest water level detectable by said water level detecting unit, causes said lock unit to lock said door, and when said water level detecting unit does not detect a water level not lower than said first water level, power supply to said control portion is turned off.

7. The washing machine according to claim 6, said control portion being further configured, when said wash cycle is completed, to cause said lock unit to unlock said door.

8. The washing machine according to claim 6, further comprising:

a drainage unit draining water in said water tank; and a lock detecting unit detecting whether said door is locked by said lock unit or not; wherein when said water level detecting unit detects a water level not lower than said first water level after the completion of said operation for washing and said lock detecting unit detects that said door is not locked by said lock unit, said control portion being further configured to cause said drainage unit to drain off the water in said water tank.

9. The washing machine according to claim 8, said control portion being further configured, when said lock unit is caused to lock said door and said lock detecting unit detects that said door is not locked, to notify that said door is not locked.

10. The washing machine according to claim 6, further comprising a drainage unit for draining off the water in said water tank;

said control portion being further configured, after completion of said wash cycle, when said water level detecting unit detects a water level not lower than a second water level higher than said first water level, to cause said drainage unit to drain off the water in said water tank.

11. The washing machine according to claim 10, wherein said second water level is positioned lower than a lowermost plane of said opening of said water tank.

* * * * *